US008740727B2

(12) United States Patent
Nagasawa et al.

(10) Patent No.: US 8,740,727 B2
(45) Date of Patent: Jun. 3, 2014

(54) COLORED GOLF BALL

(75) Inventors: Hiroyuki Nagasawa, Saitama-ken (JP); Satoshi Matsuda, Saitama-ken (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 599 days.

(21) Appl. No.: 12/956,875

(22) Filed: Nov. 30, 2010

(65) Prior Publication Data

US 2011/0070977 A1 Mar. 24, 2011

Related U.S. Application Data

(63) Continuation-in-part of application No. 12/487,096, filed on Jun. 18, 2009, now Pat. No. 8,460,124.

(30) Foreign Application Priority Data

Apr. 13, 2009 (JP) ..... 2009-097060

(51) Int. Cl.
*A63B 37/06* (2006.01)

(52) U.S. Cl.
USPC ..... 473/378

(58) Field of Classification Search
USPC ..... 473/378, 351
See application file for complete search history.

(56) References Cited

U.S. PATENT DOCUMENTS

| | | | | |
|---|---|---|---|---|
| 6,022,279 | A | 2/2000 | Yamagishi et al. | |
| 6,435,984 | B1 * | 8/2002 | Ohama | 473/377 |
| 6,561,923 | B1 | 5/2003 | Ohama et al. | |
| 6,569,037 | B2 | 5/2003 | Ichikawa et al. | |
| 7,568,986 | B2 | 8/2009 | Watanabe et al. | |
| 7,951,526 | B2 | 5/2011 | Hayashi | |
| 7,999,019 | B2 | 8/2011 | Nakamura et al. | |
| 2005/0009640 | A1 * | 1/2005 | Isogawa et al. | 473/371 |
| 2009/0054176 | A1 | 2/2009 | Isogawa et al. | |
| 2009/0075758 | A1 | 3/2009 | Nakamura et al. | |
| 2010/0004072 | A1 | 1/2010 | Komatsu et al. | |
| 2011/0224020 | A1 | 9/2011 | Tachibana et al. | |
| 2012/0015763 | A1 | 1/2012 | Isogawa et al. | |

FOREIGN PATENT DOCUMENTS

| | | | |
|---|---|---|---|
| JP | 10-155937 | A | 6/1998 |
| JP | 2000-24139 | A | 1/2000 |
| JP | 2000-254250 | A | 9/2000 |
| JP | 2002-143345 | A | 5/2002 |
| JP | 2003-126299 | A | 5/2003 |
| JP | 2004-33594 | A | 2/2004 |
| JP | 2004-81350 | A | 3/2004 |
| JP | 2007-144097 | A | 6/2007 |

(Continued)

OTHER PUBLICATIONS

Japanese Office Action issued on Oct. 24, 2012 from the Japanese Patent Office in Japanese Application No. 2009-097060.

*Primary Examiner* — Raeann Gorden
(74) *Attorney, Agent, or Firm* — Sughrue Mion, PLLC

(57) ABSTRACT

In a colored golf ball having a core, a cover of at least one layer encasing the core, and a layer of paint applied to a surface of an outermost layer of the cover, the outermost cover layer and/or the paint layer is colored with a fluorescent dye and titanium oxide, and the golf ball itself has a color tone which satisfies specific ranges in the Lab color system. The ball is endowed with an excellent spin performance and durability, an appearance characterized by outstanding visibility, stylishness and elegance, and an excellent weather resistance.

14 Claims, 1 Drawing Sheet

(56) References Cited

FOREIGN PATENT DOCUMENTS

| | | | |
|---|---|---|---|
| JP | 2009-034504 | A | 2/2009 |
| JP | 2009-045347 | A | 3/2009 |
| JP | 2009-066241 | A | 4/2009 |
| JP | 2009-066255 | A | 4/2009 |
| JP | 2010-012250 | A | 1/2010 |
| JP | 2011-183136 | A | 9/2011 |
| WO | 2006/121172 | A1 | 11/2006 |

* cited by examiner

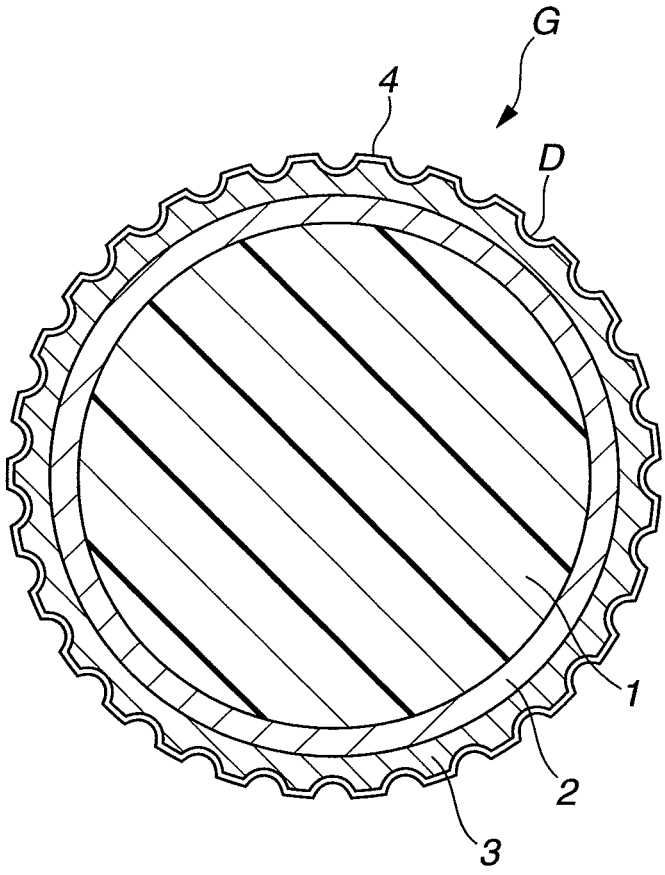
G
4
D
1
2
3

COLORED GOLF BALL

CROSS-REFERENCE TO RELATED APPLICATION

This application is a continuation-in-part of copending application Ser. No. 12/487,096 filed on Jun. 18, 2009, the entire contents of which are hereby incorporated by reference.

BACKGROUND OF THE INVENTION

The present invention relates to a colored golf ball having a fluorescent color. More specifically, the invention relates to a colored golf ball endowed with an excellent spin performance and durability, an appearance characterized by outstanding visibility, stylishness and elegance, and an excellent weather resistance.

Lately, not all golf balls are white; a variety of colored balls have appeared on the market in response to the preferences of golfers. In particular, highly stylish colored golf balls and colored golf balls with an elegance appearance have been developed to suit the tastes of women golfers.

At the same time, with the increasing versatility of golf balls in recent years, adopting a ball construction of at least three pieces—namely, a core, an intermediate layer and a cover—is becoming a precondition for the creation of golf balls acceptable to the skilled golfer. In multi-piece solid golf balls composed of three or more pieces, the sensory impressions evoked by the ball vary with differences in the thicknesses and colors of the respective layers. Moreover, in addition to ball performance, from a psychological standpoint, using a golf ball having a favorite color imparts a beneficial psychological effect on the golfer, improving his or her performance. Yet, few colored golf balls for the skilled golfer which take such factors into account, particularly colored golf balls with an outermost cover layer made of a polyurethane material, are available on the market.

Colored golf balls that have been disclosed to date include the following prior art.

JP-A 10-155937 discloses a golf ball which is colored in a non-white shade. Expressing the color tone of this ball in the Lab color system, the cover is given a blue, green, pink, yellow or orange color having an L value of at least 80, an a value of from −30 to +30, and a b value of from −30 to +30. Although this golf ball is more stylish than earlier colored golf balls, the colors within these ranges are pale colors, as a result of which the ball lacks an elegant appearance and a bright coloration. There is also room for improvement in achieving further stylishness.

JP-A 2000-024139 describes a golf ball in which the cover-forming material includes from 3.0 to 7.0 parts by weight of one or more type, of fluorescent pigment and from 0.05 to 0.5 part by weight of titanium oxide per 100 parts by weight of resin, and which has one or more layer of clear paint on the cover. However, given that the amount of fluorescent pigment included is somewhat high and that from 0.05 to 0.5 part by weight of titanium oxide is additionally combined therewith, the color tends to be too intense, in addition to which the ball is somewhat lacking in luminosity. As a result, although this prior-art ball does have an excellent visibility, it falls a little short in terms of elegance.

JP-A 2000-254250 teaches a colored golf ball of good visibility having at least one colored layer, which colored layer contains a white organic pigment and/or a white inorganic pigment, a fluorescent pigment, and an inorganic pigment and/or organic pigment. However, this golf ball has a pale color tone, and thus leaves something to be desired in terms of elegance and brightness of color.

JP-A 2003-126299 discloses a golf ball of a bright yellow color which, even when used in a harsh environment, has an excellent weather resistance and does not readily undergo fading or discoloration. This golf ball, although brightly colored and having an excellent weather resistance, exhibits a deep yellow hue, which is a color tone that lacks elegance.

JP-2004-081350 describes a painted golf ball in which a coat of paint containing a polarizing pigment has been formed on the surface of a golf ball body. The paint also contains a non-white colorant. The surface of the golf ball body is imparted with a color other than white, and has a lightness L* value, based on the L*a*b* color system, of 50 or less. However, this golf ball does not have a sufficient lightness, and thus falls somewhat short in terms of stylishness and visibility.

JP-A 2004-033594 discloses a golf ball which is colored blue, pink or yellow, and which has an excellent visibility without being visually disconcerting. The L, a and b values are described as satisfying a specific formula. Even though this golf ball has an excellent visibility without being visually disconcerting, there remains room for improvement in luminosity and elegance.

JP-A 2007-144097 describes a golf ball of enhanced visibility wherein the cover is formed of a cover material composed of a transparent resin composition to which has been added a fluorescent dye. Although this golf ball does achieve a relatively vivid color tone, when a fluorescent dye is used, color changes such as fading tend to arise with the passage of time and exposure to the elements. Accordingly, here too, there remains room for further improvement.

SUMMARY OF THE INVENTION

It is therefore an object of the present invention to provide a colored golf ball which has an excellent spin performance and durability, an appearance characterized by outstanding visibility, stylishness and elegance, and an excellent weather resistance.

The inventors have discovered that a colored golf ball having a core, a cover of at least one layer encasing the core, and a layer of paint applied to a surface of an outermost cover layer that is preferably formed of polyurethane, wherein the outermost cover layer and/or the layer of paint is colored with a fluorescent dye and titanium oxide and the golf ball itself has a color tone, at a measurement area diameter of 5 mm in a method of measuring the color of a reflecting object according to JIS Z-8722, which satisfies specific ranges in the Lab color system, is endowed with an excellent spin performance and durability, an excellent weather resistance, and an appearance characterized by outstanding visibility, stylishness and elegance.

Accordingly, the present invention provides a colored golf ball having a core, a cover of at least one layer encasing the core, and a layer of paint applied to a surface of an outermost layer of the cover. The outermost cover layer and/or the paint layer is colored with a fluorescent dye and titanium oxide. In addition, the golf ball itself has a color tone, at a measurement area diameter of 5 mm in a method of measuring the color of a reflecting object according to JIS Z-8722, which, expressed in the Lab color system, satisfies the conditions $35 \leq L$, $-40 \leq a \leq 70$, and $-60 \leq b \leq 60$.

In one embodiment, the fluorescent dye in the outermost cover layer and/or the paint layer is a perinone fluorescent dye, and the color tone of the golf ball itself, expressed in the Lab color system, satisfies the conditions $50 \leq L$, $-10 \leq a \leq 30$, and 10≤b≤50. In another embodiment, the fluorescent dye in the outermost cover layer and/or the paint layer is an anthraquinone fluorescent dye, and the color tone of the golf ball itself, expressed in the Lab color system, satisfies the conditions 40≤L, 30≤a≤70, and −20≤b≤20. In yet another embodiment, the fluorescent dye in the outermost cover layer or the paint layer or both is a fluorescent dye selected from the group consisting of perylene, monoazo and quinoline dyes, and the color tone of the golf ball itself, expressed in the Lab color system, satisfies the conditions 60≤L, −40≤a≤0, and 20≤b≤60. In a further embodiment, the fluorescent dye in the outermost cover layer or the paint layer or both is an anthraquinone fluorescent dye, and the color tone of the golf ball itself, expressed in the Lab color system, satisfies the conditions 35≤L, −30≤a≤10, and −60≤b≤−20.

The outermost cover layer is preferably made of a resin selected from the group consisting of thermoset polyurethanes, thermoplastic polyurethanes and reaction injection-molded polyurethanes. The outermost cover layer is more preferably made of a thermoplastic polyurethane, particularly a thermoplastic polyurethane which includes as a component thereof an aromatic or alicyclic polyisocyanate, and especially an aromatic polyisocyanate.

It is advantageous for the outermost cover layer to be colored with a fluorescent dye and titanium oxide, and to be composed of 100 parts by weight of a base resin, from 0.01 to 0.10 part by weight of at least one type of fluorescent dye and from 0.1 to 0.5 part by weight of titanium oxide.

In a further embodiment of the colored golf ball of the invention, the core or an intermediate spherical body composed of the core and a cover of at least one layer encasing the core is colored white and is optionally encased by a clear resin layer having a thickness of from 0.5 to 2.5 mm; the core or the intermediate spherical body has a color tone, at a measurement area diameter of 5 mm, which, expressed in the Lab color system, satisfies the conditions 40≤L, −5≤a≤5, and −5≤b≤5; and the core or intermediate spherical body which is colored white, or a sphere comprising the white-colored core or intermediate spherical body encased by a clear resin layer, is encased by an outermost cover layer having a thickness of from 0.3 to 2.0 mm.

In a still further embodiment, the core or an intermediate spherical body composed of the core and a cover of at least one layer encasing the core is colored similar to the color of the outermost cover layer and/or the paint layer that is colored with a fluorescent dye and titanium oxide (fluorescent dye-colored layer) and is optionally encased by a clear resin layer having a thickness of from 0.5 to 2.5 mm; the core or the intermediate spherical body has a color difference ΔE with the color of the fluorescent dye-colored layer at a measurement area diameter of 5 mm, which, expressed in the Lab color system, is less than 15; and the core or intermediate spherical body which is colored similar to the color of the fluorescent dye-colored layer, or a sphere comprising the similarly colored core or intermediate spherical body encased by a clear resin layer, is encased by an outermost cover layer having a thickness of from 0.3 to 2.0 mm.

The colored golf ball itself may have a color tone at a measurement area diameter of 5 mm and a color tone at a measurement area diameter of 15 mm, such that the color difference ΔE therebetween is larger than 5.

The colored golf ball may have a change in color ΔE after 24 hours of irradiation with a mercury vapor lamp of 8 or less.

The layer of paint applied to the outermost cover layer may be composed of 100 parts by weight of a base resin composition and from 0.1 to 10 parts by weight of a polarizing pigment. Alternatively, the layer of paint applied to the outermost cover layer may be composed of 100 parts by weight of a base resin composition and from 0.2 to 8 parts by weight of a polarizing pigment.

The colored golf ball of the invention has an excellent spin performance and durability, an appearance characterized by outstanding visibility, stylishness and elegance, and an excellent weather resistance. In particular, by employing a polyurethane material in the outermost cover layer, the resulting ball will be endowed with the excellent spin performance and durability desired by skilled golfers. At the same time, unlike the white coloration of conventional golf balls, the inventive balls have an appearance endowed with outstanding stylishness and elegance, and also have an excellent visibility, making it possible for the golfer to differentiate herself or himself from other golfers.

BRIEF DESCRIPTION OF THE DIAGRAMS

FIG. 1 is a schematic cross-sectional view of a golf ball according to one embodiment of the present invention.

DETAILED DESCRIPTION OF THE INVENTION

The objects, features and advantages of the invention will become more apparent from the following detailed description, taken in conjunction with the foregoing diagram.

The inventive ball has a construction which includes a core, a cover of one or more layer that encases the core, and a layer of paint applied to a surface of an outermost cover layer. Numerous dimples are generally formed on the surface of the cover. For example, the cross-sectional view of a ball in FIG. 1 shows a three-piece golf ball G having a core 1 encased by a cover, which cover is formed of two layers: an intermediate layer 2 and an outermost layer 3. A plurality of dimples D are formed on the surface of the outermost layer 3. By having the cover composed of three or more layers, a multi-piece solid golf ball of four or more pieces can be achieved. Also, the core 1 may be composed of a single layer or of two or more layers. In addition, a paint layer 4 is formed on the surface of the outermost layer 3.

The core used in the invention may be obtained by vulcanizing a rubber composition prepared by blending a known rubber material such as cis-1,4-polybutadiene as the base together with a co-crosslinking agent (e.g., unsaturated carboxylic acids and metal salts thereof), an inorganic filler (e.g., zinc oxide and barium sulfate) and an organic peroxide (e.g., dicumyl peroxide and 1,1-bis(t-butylperoxy)-cyclohexane). In the present invention, no particular limitation is imposed on the core diameter. Nor is any particular limitation imposed on the color of the core.

The cover material used in the invention may be formed primarily of a resin material which is any of various thermoplastic resins such as ionomer resins and polyurethane, or is a thermoplastic elastomer.

As noted above, the cover may be formed of a single layer or of two or more layers. Each layer of the cover has a thickness which, while not subject to any particular limitation, is preferably at least 0.3 mm, more preferably at least 0.4 mm, and even more preferably at least 0.5 mm, but preferably not more than 2.5 mm, more preferably not more than 2.0 mm, and even more preferably not more than 1.5 mm. In cases where the cover has two layers, i.e., includes an outermost layer and an intermediate layer, the combined thickness thereof is preferably from 0.8 to 3.0 mm.

When the cover is formed of two layers, various types of adhesives (primers) may be optionally applied to improve adhesion between the intermediate layer and the outermost layer.

Of the cover, it is preferable for the outermost layer to be formed primarily of a polyurethane material. Various types of urethane resins may be used, including thermoset polyurethanes, thermoplastic polyurethanes and reaction injection-molded polyurethanes. However, the use of thermoplastic polyurethanes is especially preferred on account of their high productivity and high degree of freedom of coloration, and also their high degree of freedom in compounding and designing blends or alloys thereof with various inorganic or organic fillers and with polymers other than urethane materials. Here, including an aromatic or alicyclic polyisocyanate component, especially an aromatic polyisocyanate component, within the thermoplastic polyurethane is desirable for achieving a good balance between stability at the time of production and the physical properties that are manifested. By using a polyurethane material in the outermost layer, it is possible to, achieve a golf ball which has an outstanding stylishness and elegance while at the same time exhibiting the spin performance and durability desired by skilled golfers.

The base resin itself of the outermost layer is preferably made transparent or semi-transparent in order to enhance the stylishness of the ball. In the present invention, a fluorescent dye and titanium oxide may also be mixed into this base resin. The amount of fluorescent dye included, while not subject to any particular limitation, is preferably from 0.01 to 0.1 part by weight, more preferably from 0.015 to 0.08 part by weight, and even more preferably from 0.02 to 0.06 part by weight, per 100 parts by weight of the base resin. If the amount of fluorescent dye included is too low, it may not be possible to achieve a color tone having fluorescence. On the other hand, if the amount of dye included is too high, the fluorescence will increase and the ball will have an excellent visibility, but the color tone of the ball will be too vivid, diminishing the sense of elegance and possibly making the color tone unacceptable to the golfer.

The types of fluorescent dyes formulated in the cover are not subject to any particular limitation. However, preferred use may be made of a fluorescent dye selected from the group consisting of perinone fluorescent dyes (orange), anthraquinone fluorescent dyes (pink or blue), perylene fluorescent dyes, monoazo fluorescent dyes and quinoline fluorescent dyes (yellow) on account of their excellent coloring ability and excellent discoloration resistance (weather resistance).

Because the fluorescent dye has an excellent tinting ability and coloring ability, the target color tone can be achieved by addition in a very small amount. The means employed for achieving the target color tone may be to scatter or diffuse light and thereby improve visibility or, in order to intentionally increase the hiding power, to add an inorganic filler, examples of which include, but are not limited to, aluminum hydroxide, calcium carbonate and titanium oxide. In this invention, the use of titanium oxide is especially preferred.

The method used to color the cover (outermost layer) with the fluorescent dye may involve blending a fluorescent dye in the state of a finely divided powder into the cover-forming resin material so as to give a colored resin. Alternatively, to improve the fluorescent dye dispersibility and the workability, a masterbatch prepared beforehand from the fluorescent dye in the state of a powder and a resin (preferably the same as the cover-forming resin material), or a solution of the fluorescent dye dissolved in water or a nonaqueous solvent, may be incorporated in a suitable amount within the cover-forming resin material.

Next, the amount of titanium oxide included, while not subject to any particular limitation, is preferably from 0.1 to 0.5 part by weight, more preferably from 0.15 to 0.45 part by weight, and even more preferably from 0.2 to 0.4 part by weight, per 100 parts by weight of the base resin. If the amount of titanium oxide included is too low, the interaction between light scattering and light diffusion that occurs with the joint use of a fluorescent dye and titanium oxide may not arise. On the other hand, if the amount of titanium oxide included is too high, the hiding power due to the titanium oxide becomes excessive, as a result of which the color tone tends toward a whitish shade lacking in transparency, which may make it impossible to effectively manifest the degree of coloration possessed by the fluorescent dye.

A plurality of dimples are formed on the surface of the outermost cover layer. Because the dimples, by virtue of their diameter, number and depth, exert an influence on the appearance of the ball, it is preferable to form the dimples in a range that does not detract from the advantageous effects of the invention. More specifically, the number of such dimples, while not subject to any particular limitation, is preferably at least 250 but not more than 330. The dimples formed on the surface of the ball have a surface coverage (SR) which, while not subject to any particular limitation, is preferably at least 80%, and more preferably at least 90%, but preferably not more than 98%, and more preferably not more than 95%. For example, if the number of dimples is too large, when light strikes the ball, the visibility effect of the colored ball may diminish. That is, depending on the angle from which the ball is viewed, shadows will form at the bottoms of the dimples, which may cause the ball to appear darker. On the other hand, if the number of dimples is too small, good aerodynamic properties cannot be obtained when the ball is hit, as a result of which the ball may not travel the desired distance.

When a sphere having the above-described cover is manufactured, a rubber composition composed primarily of polybutadiene or the like may be vulcanized under ordinary vulcanization conditions to form a crosslinked rubber molding (core), following which the cover (intermediate layer and outermost layer) may be successively molded over the core by a known process such as injection molding. Generally, a large number of dimples are formed on the surface of the outermost cover layer, the dimples being formed at the same time as formation of the outermost cover layer through the use of an outermost cover layer forming mold provided on the inner wall of the mold cavity thereof with a plurality of projections corresponding to the dimples.

As shown in FIG. 1, the surface of the outermost cover layer is covered by a layer of paint 4. This paint layer 4 has a thickness which, while not subject to any particular limitation, is preferably at least 5 μm, and more preferably at least 10 μm, but preferably not more than 20 μm, and more preferably not more than 16 μm. If the paint layer is too thin, the paint may have a poor durability. On the other hand, if the paint layer is too thick, the paint may have a large effect on the dimple shape, which may make it impossible to obtain flight properties according to design and may thus result in the ball traveling a less than desirable distance. Also, if the paint layer is too thick, the paint will have a tendency to peel, which may lower the durability of the ball to repeated impact.

It is preferable to use in the paint layer a paint which is commonly used to coat the surface of golf balls. Illustrative examples include urethane resin paints, acrylic resin paints, polyester resin paints, polyether resin paints, epoxy resin paints, modified forms thereof, or mixtures of any of the above. Of these, a two-component curing urethane resin paint obtained from a mixture of a polyisocyanate with a urethane resin, acrylic resin or polyester resin includes on the resin skeleton functional groups, particularly hydroxyl groups, capable of reacting with isocyanate groups is preferred.

Examples of polyisocyanates that may be used include tolylene diisocyanate, diphenylmethane-4,4'-diisocyanate (MDI), hexamethylene diisocyanate, isophorone diisocyanate, naphthalene diisocyanate, 1,4-phenylene diisocyanate, xylylene diisocyanate and hydrogenated xylylene diisocyanate, either singly or in modified forms as combinations thereof. The polyisocyanate component may generally take the form of an adduct, a biuret or an isocyanurate.

When the paint layer is formed by clear coating (coating with a clear paint), it is preferable to use a two-component curing urethane paint composed of a polyol component having hydroxyl groups and a polyisocyanate component having isocyanate groups.

Any known method used in the art may be employed as the coating method. For example, the ball may be perched on the tips of needles on a needle bed, and the entire ball coated with various paints by spraying. Prior to coating, any of a variety of techniques may be used to improve adhesion between the object to be coated and the layer of paint. Illustrative, non-limiting examples of such techniques include surface modification by plasma treatment or corona discharge treatment, and the application of a primer.

The paint layer in the present invention may include a fluorescent dye and titanium oxide. In cases where a fluorescent dye and titanium oxide are used in the paint layer, a fluorescent dye and titanium oxide similar to those used in the outermost cover layer described above may be employed. When a fluorescent dye is included in the paint layer, although not subject to any particular limitation, it is recommended that the amount of fluorescent dye used per 100 parts by weight of paint film solids be in a range of from 0.01 to 10 parts by weight, and preferably from 0.1 to 8 parts by weight. If the amount of fluorescent dye included is too low, the hiding power of the paint film may be poor, as a result of which the desired coloration may not be achieved. On the other hand, if the amount of fluorescent dye included is too high, the durability and other physical properties of the paint film may be diminished.

The amount of titanium oxide included, while not subject to any particular limitation, is preferably from 0.01 to 20 parts by weight, more preferably from 0.05 to 10 parts by weight, and even more preferably from 0.1 to 5 parts by weight, per 100 parts by weight of paint film solids. If the amount of titanium oxide included is too low, the interaction between light scattering and light diffusion that occurs when the titanium oxide is used together with a fluorescent dye may not arise. On the other hand, if the amount of titanium oxide included is too high, the color tone tends toward a whitish shade, and the durability and other physical properties of the paint film may be diminished.

In cases where the above paint layer colored with a fluorescent dye and titanium dioxide is to be formed, if necessary, a primer or sealer may be applied prior to applying the colored paint layer.

Another embodiment of the paint layer, although not shown in the appended diagram, involves spraying or otherwise applying a fluorescent dye and titanium oxide-containing colored material onto the dimple-bearing surface of the outermost cover layer, then applying thereon a coating such as a conventional clear coating so as to form a layer of colored paint. In such a case, the layer of paint will be composed of two layers—a very thin, colored layer and a clear coat.

Generally, in the paint, various solvents and additives are suitably added to the above-described resin, in addition to which a polarizing pigment may also be included. When a polarizing pigment is used, it is advantageous to include from 0.05 to 0.5 part by weight of a fluorescent whitener and from 0.1 to 10 parts by weight, preferably 0.2 to 8 parts by weight, of the polarizing pigment per 100 parts by weight of the base resin. If the amount of polarizing pigment included is too low, brightness cannot be manifested at the surface of the ball. On the other hand, if the amount of polarizing pigment included is too high, mutual interference of the light may occur, resulting in a loss of brightness. Excessive polarizing pigment may also alter the spin performance of the ball or cause the layer of paint to peel. In addition, because polarizing pigments are generally expensive, including more than a suitable amount merely leads to an unnecessary rise in cost. Also, polarizing pigments tend to settle in the paint prior to curing, which may worsen productivity in the paint coating step. It is preferable for the fluorescent whitener and, the polarizing pigment to be used in such a way that the weight ratio therebetween (fluorescent whitener/polarizing pigment) is from 0.08 to 0.5. Adjusting the ratio of fluorescent whitener to polarizing pigment is important for bringing out the luminosity and brightness of the ball. If the fluorescent whitener and the polarizing pigment are added in amounts that are inappropriate, the ball may not have a suitable luminosity, as a result of which the objects of the invention may not be achieved.

A pearlescent pigment may be suitably used as the polarizing pigment. Pearlescent pigments are broadly divided into metal oxide-coated micas, basic lead carbonate, bismuth oxychloride, and natural pearl essence. Of these, the selection of a metal oxide-coated mica is preferred because such pigments are nontoxic and have the best chemical stability. Titanium dioxide or iron oxide is typically used as the metal oxide coating the mica; by varying the coverage (thickness of the coating layer), various colors and interference effects can be achieved. The larger the particle size of these pigments, the greater the degree of brightness that can be achieved. However, at a larger pigment particle size, the particles have a tendency to settle in the paint. Hence, it is desirable to select a pigment having a suitable particle size.

In a golf ball which has a paint layer formed of a paint that contains such a pearlescent pigment, because the ball is able to reflect light at various angles, the sense of elegance is increased. Moreover, the ball thoroughly reflects sunlight, making the golf ball easier to find.

In the present invention, the golf ball itself is characterized by having a color tone, at a measurement area diameter of 5 mm in a method of measuring the color of a reflecting object according to JIS Z-8722 (2000), which, expressed in the Lab color system, satisfies the conditions $35 \leq L$, $-40 \leq a \leq 70$, and $-60 \leq b \leq 60$. These color test evaluations may be carried out using a measurement area diameter of 15 mm in order to collect data for a broader region. Regarding the difference between measurement area diameters of 5 mm and 15 mm, the greater the difference in color tone that exists between a diameter of 5 mm and a diameter of 15 mm, the better the brightness and visibility of the golf ball. In particular, given that the invention concerns a golf ball, which is an object having a small diameter, in order to impart an unprecedented sense of quality and visibility capable of being manifested from the color tone of this small ball, it is necessary to comprehensively assess the color of the ball by measuring the color tone at not only a measurement area diameter of 15 mm, but also a small measurement area diameter of 5 mm. Specifically, it is desirable for the difference $\Delta E$ between the color tone of the ball at a measurement area diameter of 5 mm and the color tone of the ball at a measurement area diameter of 15 mm to be larger than 5.

When the fluorescent dye included in the outermost cover layer and/or the paint layer is an orange fluorescent dye, the color tone of the golf ball, expressed in the Lab color system, preferably satisfies the conditions 50≤L, −10≤a≤30, and 10≤b≤50. When the fluorescent dye included is a pink fluorescent dye, the color tone of the golf ball, expressed in the Lab color system, preferably satisfies the conditions 40≤L, 30≤a≤70, and −20≤b≤20. When the fluorescent dye included is a yellow fluorescent dye, the color tone of the golf ball, expressed in the Lab color system, preferably satisfies the conditions 60≤L, −40≤a≤0, and 20≤b≤60. When the fluorescent dye included is a blue fluorescent dye, the color tone of the golf ball, expressed in the Lab color system, preferably satisfies the conditions 35≤L, −30≤a≤10, and −60≤b≤−20.

One embodiment that makes effective use of specific advantages of the present invention is a colored golf ball having a construction wherein a core or an intermediate spherical body composed of the core and one or more cover layer encasing the core is colored white and is optionally encased by a clear resin layer having a thickness of from 0.5 to 2.5 mm; the core or intermediate spherical body has a color tone, at a measurement area diameter of 5 mm, which, expressed in the Lab color system, satisfies the conditions 40≤L, −5≤a≤5, and −5≤b≤5; and the white-colored core or intermediate spherical body, or a sphere composed of these encased by a clear resin layer, is encased by an outermost cover layer having a thickness of from 0.3 to 2.0 mm. In another such embodiment, the colored golf ball has a construction wherein a core or an intermediate spherical body composed of the core and one or more cover layer encasing the core is colored similar to the color of an outermost cover layer and/or paint layer colored by a fluorescent dye and titanium oxide (fluorescent dye-colored layer) and is optionally encased by a clear resin layer having a thickness of from 0.5 to 2.5 mm; the core or intermediate spherical body has a color difference ΔE with the color of the fluorescent dye-colored layer at a measurement area diameter of 5 mm, which, expressed in the Lab color system, is less than 15; and the core or intermediate spherical body colored similar to the color of the fluorescent dye-colored layer, or a sphere composed of these encased by a clear resin layer, is encased by an outermost cover layer having a thickness of from 0.3 to 2.0 mm.

Also, in the present invention, it is preferable for the ball to have a color difference ΔE, when irradiated for 24 hours with a mercury vapor lamp, of 8 or less. This color difference ΔE is the difference in color between the ball prior to irradiation and the ball after 24 hours of irradiation; a smaller value indicates less change in color. Measurement of the color difference ΔE for the ball may be carried out using a known color difference meter, based on the criteria of JIS Z-8701 (1999).

Also, because it is undesirable for the surface of a golf ball to undergo ready discoloration by ultraviolet light, it is recommended that, as a measure of yellowing resistance, when the surface of a golf ball is irradiated for 24 hours with a mercury vapor lamp, the discoloration difference (ΔYI), based on the reflection method of JIS K-7103, between the golf ball surface following irradiation and the golf ball surface prior to irradiation, be at least −10 but not more than 10.

The color of the ball may be used to differentiate, based on consumer color preferences and self-image, between balls for men and balls for women, or to differentiate, based on ball performance, between distance balls and spin balls. Providing colored golf balls is generally also an effective strategy for encouraging product selection by the user from among an array of commercial golf balls that are predominantly white.

The golf ball of the invention, which can be manufactured so as to conform with the Rules of Golf for competitive play, may be produced to a ball diameter which is not less than 42.67 mm and to a weight which is not more than 45.93 g.

EXAMPLES

The following Examples of the invention and Comparative Examples are provided by way of illustration and not by way of limitation.

Examples 1 to 13, Comparative Examples 1 to 4

In each example and comparative example below, the rubber composition shown in Table 1 below was prepared, masticated in a kneader or roll mill, then fashioned into a core under vulcanization conditions of 155° C. and 20 minutes. Next, the resin composition shown in Table 2 was injection-molded around the core with an injection mold, thereby producing a sphere composed of the core encased by an intermediate layer. The sphere was then set in a different mold and an outermost cover layer material containing the specific amounts of fluorescent dye and titanium oxide shown in Table 3 was injection-molded. Next, the cover surface was plasma-treated, following which either (1) a non-yellowing urethane/acrylic resin-based paint was applied thereto by spray painting and dried, thereby coating the cover surface with a layer of clear paint having a thickness of about 15 μm, or (2) a specific amount of a pearlescent pigment was blended into a non-yellowing urethane/acrylic resin-based paint resin and the resulting mixture was applied to the cover surface by spray painting and dried, thereby coating the cover surface with a layer of pearlescent paint having about the same thickness.

TABLE 1

| Core | Example | | | | | | | | | | | | | Comparative Example | | | |
|---|---|---|---|---|---|---|---|---|---|---|---|---|---|---|---|---|---|
| formulation | 1 | 2 | 3 | 4 | 5 | 6 | 7 | 8 | 9 | 10 | 11 | 12 | 13 | 1 | 2 | 3 | 4 |
| Polybutadiene | 100 | 100 | 100 | 100 | 100 | 100 | 100 | 100 | 100 | 100 | 100 | 100 | 100 | 100 | 100 | 100 | 100 |
| Zinc acrylate | 30 | 30 | 30 | 30 | 30 | 30 | 30 | 30 | 30 | 30 | 30 | 30 | 30 | 30 | 30 | 30 | 29 |
| Zinc oxide | 5 | 5 | 5 | 5 | 5 | 5 | 5 | 5 | 5 | 5 | 5 | 5 | 5 | 5 | 5 | 5 | 26.7 |
| Barium sulfate | 18.6 | 18.6 | 18.6 | 18.6 | 18.6 | 18.6 | 18.6 | 18.6 | 18.6 | 18.6 | 18.6 | 18.6 | 18.6 | 18.6 | 18.6 | 18.6 | 0 |
| Antioxidant | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 | 0.1 |
| Zinc stearate | 5 | 5 | 5 | 5 | 5 | 5 | 5 | 5 | 5 | 5 | 5 | 5 | 5 | 5 | 5 | 5 | 0 |
| Zinc salt of pentachloro-thiophenol | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 | 0.2 |

TABLE 1-continued

| Core formulation | Example 1 | 2 | 3 | 4 | 5 | 6 | 7 | 8 | 9 | 10 | 11 | 12 | 13 | Comparative Example 1 | 2 | 3 | 4 |
|---|---|---|---|---|---|---|---|---|---|---|---|---|---|---|---|---|---|
| Peroxide | 1.2 | 1.2 | 1.2 | 1.2 | 1.2 | 1.2 | 1.2 | 1.2 | 1.2 | 1.2 | 1.2 | 1.2 | 1.2 | 1.2 | 1.2 | 1.2 | 1.2 |
| Colorant (1) | — | — | — | — | — | — | — | — | — | — | — | — | — | 0.015 | — | — | 0.08 |
| Colorant (2) | — | — | — | — | — | — | — | — | — | — | — | — | — | 0.03 | — | — | — |

Ingredient amounts shown above are in parts by weight.

The materials used in the core formulations are described below.

Polybutadiene: cis-1,4-Polybutadiene, available from JSR Corporation under the trade name "BR 730"

Zinc acrylate: A mixture of zinc acrylate and zinc stearate, available from Nippon Shokubai Co., Ltd.

Zinc oxide: Grade 3 zinc oxide, available from Sakai Chemical Industry Co., Ltd.

Barium sulfate: Available from Sakai Chemical Industry Co, Ltd. under the trade name "Precipitated Barium Sulfate #100"

Antioxidant: Available from Ouchi Shinko Chemical Industry Co., Ltd. under the trade name "Nocrac NS-6"

Zinc stearate: Available from NOF Corporation under the trade name "Zinc Stearate G"

Zinc salt of pentachlorothiophenol: Zhejiang Cho & Fu Chemical Co., Ltd. (China)

Peroxide: Available from NOF Corporation under the trade name "Perhexa C-40"

Colorant (1): Resino Red K-50% LB, available from Resino Color Industry Co., Ltd.

Colorant (2): Resino Green GBA-50% LB, available from Resino Color Industry Co., Ltd.

The following materials were used in formulating the intermediate layer.

Himilan 1605: A sodium-neutralized ethylene-methacrylic acid-acrylic acid ester copolymer available under this trade name from DuPont-Mitsui Polychemicals Co., Ltd.

Himilan 1706: A zinc-neutralized ethylene-methacrylic acid-acrylic acid ester copolymer available under this trade name from DuPont-Mitsui Polychemicals Co., Ltd.

Himilan 1557: A zinc-neutralized ethylene-methacrylic acid-acrylic acid ester copolymer available under this trade name from DuPont-Mitsui Polychemicals Co., Ltd.

Surlyn 6320: A magnesium-neutralized ethylene-methacrylic acid-acrylic acid ester copolymer available under this trade name from E.I. DuPont de Nemours & Co.

Nucrel 035C: An ethylene-methacrylic acid-acrylic acid ester copolymer available under this trade name from DuPont-Mitsui Polychemicals Co., Ltd.

Titanium oxide: Available from Ishihara Sangyo Kaisha, Ltd. under the trade name "Tipaque R550"

Red pigment: Quinacridone Red

Magnesium stearate: Available from NOF Corporation under the trade name "Magnesium Stearate G"

TABLE 2

| Cover (intermediate layer) formulation | | Example 1 | 2 | 3 | 4 | 5 | 6 | 7 | 8 | 9 | 10 | 11 | 12 | 13 | Comparative Example 1 | 2 | 3 | 4 |
|---|---|---|---|---|---|---|---|---|---|---|---|---|---|---|---|---|---|---|
| Himilan 1605 | | 50 | 50 | 50 | 50 | 50 | 50 | 50 | 50 | 50 | 50 | 50 | 50 | 50 | 50 | 50 | 50 | — |
| Himilan 1706 | | 35 | 35 | 35 | 35 | 35 | 35 | 35 | 35 | 35 | 35 | 35 | 35 | 35 | 35 | 35 | 35 | — |
| Himilan 1557 | | 15 | 15 | 15 | 15 | 15 | 15 | 15 | 15 | 15 | 15 | 15 | 15 | 15 | 15 | 15 | 15 | — |
| Surlyn 6320 | | — | — | — | — | — | — | — | — | — | — | — | — | — | — | — | — | 60 |
| Nucrel 035C | | — | — | — | — | — | — | — | — | — | — | — | — | — | — | — | — | 40 |
| Titanium oxide | | — | — | — | — | 2.5 | — | 2.5 | 2.5 | — | — | 2.5 | — | 2.5 | — | — | — | 4.1 |
| Red pigment (Quinacridone Red) | | — | — | — | — | — | — | — | — | — | 0.006 | — | — | — | — | — | — | — |
| Magnesium stearate | | — | — | — | — | — | — | — | — | — | — | — | — | — | — | — | — | 70 |
| Magnesium oxide | | — | — | — | — | — | — | — | — | — | — | — | — | — | — | — | — | 0.8 |
| Color tone in intermediate layer-covered spherical body (core + intermediate layer) (measurement area diameter, 5 mm) | L | 51.0 | 51.0 | 51.0 | 51.0 | 96.9 | 51.0 | 96.9 | 96.9 | 51.0 | 54.1 | 96.9 | 51.0 | 96.9 | 41.5 | 51.0 | 51.0 | 91.5 |
| | a | −0.3 | −0.3 | −0.3 | −0.3 | −0.7 | −0.3 | −0.7 | −0.7 | −0.3 | 14.5 | −0.7 | −0.3 | −0.7 | 7.3 | −0.3 | −0.3 | −0.4 |
| | b | 1.2 | 1.2 | 1.2 | 1.2 | 1.2 | 1.2 | 1.2 | 1.2 | 1.2 | 0.4 | 1.2 | 1.2 | 1.2 | 2.1 | 1.2 | 1.2 | 2.6 |

Ingredient amounts shown above are in parts by weight.

Magnesium oxide: Available from Kyowa Chemical Industry Co., Ltd.

Titanium oxide: Available under the trade name "Tipaque R550" from Ishihara Sangyo Kaisha, Ltd.

TABLE 3

| | | Example | | | | | | | | | | | | | Comparative Example | | | |
|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 13 | 1 | 2 | 3 | 4 |
| outer-most cover layer formu-lation | Pandex T8290 | 75 | 75 | 75 | 75 | 75 | 75 | 75 | 75 | 75 | 75 | 75 | 75 | 75 | 75 | 75 | 75 | — |
| | Pandex T8283 | 25 | 25 | 25 | 25 | 25 | 25 | 25 | 25 | 25 | 25 | 25 | 25 | 25 | 25 | 25 | 25 | — |
| | Polyisocyanate compound | 8 | 8 | 8 | 8 | 8 | 8 | 8 | 8 | 8 | 8 | 8 | 8 | 8 | 8 | 8 | 8 | — |
| | Thermoplastic elastomer | 15 | 15 | 15 | 15 | 15 | 15 | 15 | 15 | 15 | 15 | 15 | 15 | 15 | 15 | 15 | 15 | — |
| | Himilan 1557 | — | — | — | — | — | — | — | — | — | — | — | — | — | — | — | — | 75 |
| | Himilan 1855 | — | — | — | — | — | — | — | — | — | — | — | — | — | — | — | — | 25 |
| | Polyethylene wax | 1 | 1 | 1 | 1 | 1 | 1 | 1 | 1 | 1 | 1 | 1 | 1 | 1 | 1 | 1 | 1 | — |
| | Titanium oxide | 0.3 | 0.3 | 0.3 | 0.3 | 0.3 | 0.3 | 0.3 | 0.3 | 0.3 | 0.3 | 0.3 | 0.3 | 0.3 | — | — | 3.5 | — |
| | Magnesium Stearate | — | — | — | — | — | — | — | — | — | — | — | — | — | — | — | — | 69 |
| | Magnesium oxide | — | — | — | — | — | — | — | — | — | — | — | — | — | — | — | — | 0.8 |
| | Ultramarine | — | — | — | — | — | — | — | — | — | — | — | — | — | — | — | 0.4 | — |
| | Perylene fluorescent dye | 0.03 | — | — | — | 0.03 | — | — | — | — | — | — | — | — | — | — | — | — |
| | Monoazo fluorescent dye | — | 0.03 | — | — | — | — | — | — | — | — | — | — | — | — | — | — | — |
| | Quinoline fluorescent dye | — | — | 0.03 | 0.03 | — | — | — | — | — | — | — | — | — | — | — | — | — |
| | Perinone fluorescent dye | — | — | — | — | — | 0.03 | 0.03 | 0.03 | — | — | — | — | — | — | — | — | — |
| | Anthraquinone Fluorescent dye (1) | — | — | — | — | — | — | — | — | 0.03 | — | — | — | — | — | — | — | — |
| | Anthraquinone Fluorescent dye (2) | — | — | — | — | — | — | — | — | — | 0.03 | 0.03 | — | — | — | — | — | — |
| | Anthraquinone Fluorescent dye (3) | — | — | — | — | — | — | — | — | — | — | — | 0.03 | 0.03 | — | — | — | — |
| | Orange organic fluorescent pigment | — | — | — | — | — | — | — | — | — | — | — | — | — | 1.6 | — | — | — |
| | Heterocyclic fluorescent dye | — | — | — | — | — | — | — | — | — | — | — | — | — | — | 0.09 | — | 0.09 |
| | Calcium carbonate | — | — | — | — | — | — | — | — | — | — | — | — | — | — | 1.5 | — | 1.5 |
| Paint layer | | clear | clear | clear | pearl | pearl | clear | clear | pearl | clear | pearl | pearl | clear | clear | pearl | clear | clear | clear |

Ingredient amounts shown above are in parts by weight.
In this table, "pearl" stands for pearlescent.

The following materials were used in formulating the outermost layer.

Pandex T8290: MDI-PTMG type thermoplastic polyurethane material available under this trade name from DIC Bayer Polymer, Ltd. Resin hardness (Shore A), 93. Impact resilience, 52%.

Pandex T8283: MDI-PTMG type thermoplastic polyurethane material available under this trade name from DIC Bayer Polymer, Ltd. Resin hardness (Shore A), 83. Impact resilience, 55%.

Polyisocyanate compound: 4,4'-Diphenylmethane diisocyanate

Thermoplastic elastomer: A polyester thermoplastic elastomer available under the trade name "Hytrel 4001" from DuPont-Toray Co., Ltd.

Himilan 1557: A zinc-neutralized ethylene-methacrylic acid copolymer available under this trade name from DuPont-Mitsui Polychemicals Co., Ltd.

Himilan 1855: A zinc-neutralized ethylene-methacrylic acid-acrylic acid ester copolymer available under this trade name from DuPont-Mitsui Polychemicals Co., Ltd.

Polyethylene wax: Available under the trade name "Sanwax 161P" from Sanyo Chemical Industries, Ltd.

Magnesium stearate: Available under the trade name "Magnesium Stearate G" from NOF Corporation.

Magnesium oxide: Available from Kyowa Chemical Industry Co., Ltd.

Perylene fluorescent dye: Solvent Green 5, available under the trade name "Sumiplast Yellow FL7G" from Sumika Chemtex Co., Ltd.

Monoazo fluorescent dye: Solvent Yellow 157, available under the trade name "Sumiplast Yellow HGN" from Sumika Chemtex Co., Ltd.

Quinoline fluorescent dye: Disperse Yellow 54, available under the trade name "Sumiplast Yellow HLR" from Sumika Chemtex Co., Ltd.

Perinone fluorescent dye: Solvent Orange 60, available under the trade name "Sumiplast Orange HRP" from Sumika Chemtex Co., Ltd.

Anthraquinone fluorescent dye (1): Solvent Red 149, available under the trade name "Sumiplast Red HFG" from Sumika Chemtex Co., Ltd.

Anthraquinone fluorescent dye (2): Solvent Red 150, available under the trade name "Sumiplast Red HF4G" from Sumika Chemtex Co., Ltd.

Anthraquinone fluorescent dye (3): Disperse Blue 60, available under the trade name "Sumiplast Turq. Blue G" from Sumika Chemtex Co., Ltd.

Heterocyclic fluorescent dye: Solvent Yellow 98

The physical properties, initial velocity, spin performance on approach shots, scuff resistance, visibility, elegance and brightness of the golf balls produced above were rated according to the following criteria.

Ball Deflection

The deflection (mm) of the ball when compressed under a final load of 1,275 N (130 kgf) from an initial load state of 98 N (10 kgf) was measured.

Initial Velocity

The initial velocity was measured using an initial velocity measuring apparatus of the same type as the USGA drum rotation-type initial velocity instrument approved by the R&A. The ball was held isothermally at a temperature of 23±1° C. for at least 3 hours, then tested in a room temperature (23±2° C.) chamber. The ball was hit using a 250-pound (113.4 kg) head (striking mass) at an impact velocity of 143.8 ft/s (43.83 m/s). A dozen balls were each hit four times. The time taken for the balls to traverse a distance of 6.28 ft (1.91 m) was measured and used to compute the initial velocity. This cycle was carried out over a period of about 15 minutes.

Spin on Approach Shots

The spin rate (rpm) of the ball when struck at a head speed of 20 m/s with the Tour Stage X-Wedge (loft angle, 58°) sand wedge (manufactured by Bridgestone Sports Co., Ltd.) mounted on a golf swing robot was measured.

Scuff Resistance of Ball

Golf balls were held at a temperature of 23° C., 13° C. or 0° C. and the respective balls were hit at a head speed of 33 m/s using a pitching wedge mounted on a swing robot machine, following which damage from the impact was visually rated according to the following criteria.

5: No damage whatsoever or substantially free of apparent damage.

4: Slight damage is apparent, but of minimal concern.

3: Surface is somewhat frayed.

2: Surface is frayed and damaged dimples are apparent.

1: Some dimples are completely obliterated.

Ball Color

The ball color was measured using a color difference meter (model SC-P, manufactured by Suga Test Instruments Co., Ltd.) according to JIS Z-8722: "Method of Measuring the Color of a Reflecting Object" (diffuse illumination, receiving optics with 8° viewing angle: Condition c), with d/8 geometry (measured while excluding specularly reflected component from sample with a light trap). The measurement area diameters used were 15 mm and 5 mm.

Ball Color Change Test

Using a mercury vapor lamp for color fading tests (H400-F, manufactured by Toshiba Corporation), ball color change tests were carried out at a light source to ball distance of 30 cm and a drum rate of rotation of 1 rpm. The surface of the ball was irradiated with the mercury vapor lamp for 24 hours. The change in the color of the ball surface (before versus after irradiation) was measured using a color difference meter (model SC-P, manufactured by Suga Test Instruments Co., Ltd.). Based on the Lab color system described in JIS Z-8701, the difference in color ΔE of the ball before and after irradiation was determined. A smaller color difference ΔE value indicates less discoloration.

Visibility

Sensory evaluations based-on the following criteria were carried out by ten skilled golfers.

Excellent: Eight or more of the ten golfers thought the ball was easy to see on turf Good: Five to seven of the ten golfers thought the ball was easy to see on turf Fair: Three or four of the ten golfers thought the ball was easy to see on turf NG: Two or fewer of the ten golfers thought the ball was easy to see on turf Elegance Sensory evaluations based on the following criteria were carried out by ten skilled golfers.

Excellent: Eight or more of the ten golfers thought the ball had an elegant feel Good: Five to seven of the ten golfers thought the ball had an elegant feel Fair: Three or four of the ten golfers thought the ball had an elegant feel NG: Two or fewer of the ten golfers thought the ball had an elegant feel Brightness Sensory evaluations based on the following criteria were carried out by ten skilled golfers.

Excellent: Eight or more of the ten golfers thought the ball had a bright color

Good: Five to seven of the ten golfers thought the ball had a bright color

Fair: Three or four of the ten golfers thought the ball had a bright color

NG: Two or fewer of the ten golfers thought the ball had a bright color

TABLE 4

| | | Example | | | | | | | | |
|---|---|---|---|---|---|---|---|---|---|---|
| Ball Properties | | 1 | 2 | 3 | 4 | 5 | 6 | 7 | 8 | 9 |
| Core diameter (mm) | | 37.7 | 37.7 | 37.7 | 37.7 | 37.7 | 37.7 | 37.7 | 37.7 | 37.7 |
| Intermediate layer thickness tram) | | 1.7 | 1.7 | 1.7 | 1.7 | 1.7 | 1.7 | 1.7 | 1.7 | 1.7 |
| Outermost layer thickness (mm) | | 0.8 | 0.8 | 0.8 | 0.8 | 0.8 | 0.8 | 0.8 | 0.8 | 0.8 |
| Ball diameter (mm) | | 42.7 | 42.7 | 42.7 | 42.7 | 42.7 | 42.7 | 42.7 | 42.7 | 42.7 |
| Ball weight (g) | | 45.4 | 45.3 | 45.4 | 45.4 | 45.6 | 45.4 | 45.6 | 45.5 | 45.5 |
| Deflection (mm) | | 2.7 | 2.6 | 2.6 | 2.6 | 2.6 | 2.7 | 2.6 | 2.6 | 2.5 |
| Initial velocity (m/s) | | 77.1 | 77.1 | 77.1 | 77.2 | 77.2 | 77.2 | 77.1 | 77.1 | 77.1 |
| Spin rate on approach shots (rpm) | | 6349 | 6304 | 6320 | 6348 | 6399 | 6365 | 6367 | 6329 | 6380 |
| Scuff resistance | 23° C. | 5 | 5 | 5 | 5 | 5 | 5 | 5 | 5 | 5 |
| | 13° C. | 5 | 5 | 5 | 5 | 5 | 5 | 5 | 5 | 5 |
| | 0° C. | 4 | 4 | 4 | 4 | 4 | 4 | 4 | 4 | 4 |

TABLE 4-continued

| | | | | | | | | | | | |
|---|---|---|---|---|---|---|---|---|---|---|---|
| Ball color | Measurement area diameter, 5 mm | L | 80.3 | 74.1 | 70.8 | 74.2 | 85.8 | 62.8 | 63.1 | 70.5 | 49.0 |
| | | a | −29.4 | −20.9 | −14.1 | −10.6 | −25.2 | 14.2 | 15.1 | 5.7 | 58.2 |
| | | b | 46.5 | 37.9 | 40.6 | 38.4 | 44.7 | 31.4 | 31.4 | 32.4 | −8.2 |
| | | YI | 77.7 | 71.7 | 88.7 | 84.4 | 72.9 | 105.8 | 106.5 | 83.3 | 55.7 |
| | Measurement area diameter, 15 mm | L | 92.3 | 85.7 | 81.1 | 84.5 | 97.3 | 70.4 | 71.6 | 79.0 | 53.3 |
| | | a | −29.0 | −21.2 | −10.8 | −7.2 | −24.6 | 22.5 | 24.6 | 15.2 | 71.4 |
| | | b | 55.7 | 46.6 | 48.4 | 46.1 | 54.6 | 38.2 | 39.2 | 40.2 | −4.2 |
| | | YI | 85.7 | 79.8 | 97.5 | 93.2 | 82.9 | 120.2 | 122.7 | 99.5 | 82.5 |
| | ΔE (between 5-mm value and 15-mm value) | | 15.1 | 14.5 | 13.3 | 13.3 | 15.2 | 13.2 | 15.0 | 15.0 | 14.5 |
| Color change test | ΔE | | 3.4 | 3.5 | 3.1 | 2.9 | 3.0 | 3.6 | 3.6 | 3.1 | 4.5 |
| Appearance | Visibility | | Good | Good | Good | Exc | Exc | Good | Good | Exc | Good |
| | Elegance | | Good | Good | Good | Exc | Exc | Good | Good | Exc | Good |
| | Brightness | | Good | Good | Good | Exc | Exc | Good | Good | Exc | Good |

| | | | Example | | | | Comparative Example | | | |
|---|---|---|---|---|---|---|---|---|---|---|
| Ball Properties | | | 10 | 11 | 12 | 13 | 1 | 2 | 3 | 4 |
| Core diameter (mm) | | | 37.7 | 37.7 | 37.7 | 37.7 | 37.7 | 37.7 | 37.7 | 37.3 |
| Intermediate layer thickness tram) | | | 1.7 | 1.7 | 1.7 | 1.7 | 1.7 | 1.7 | 1.7 | 1.45 |
| Outermost layer thickness (mm) | | | 0.8 | 0.8 | 0.8 | 0.8 | 0.8 | 0.8 | 0.8 | 1.25 |
| Ball diameter (mm) | | | 42.7 | 42.7 | 42.7 | 42.7 | 42.7 | 42.7 | 42.7 | 42.7 |
| Ball weight (g) | | | 45.4 | 45.6 | 45.4 | 45.6 | 45.3 | 45.4 | 45.6 | 45.4 |
| Deflection (mm) | | | 2.6 | 2.7 | 2.6 | 2.7 | 2.6 | 2.5 | 2.7 | 2.9 |
| Initial velocity (m/s) | | | 77.1 | 77.1 | 77.2 | 77.1 | 77.2 | 77.1 | 77.3 | 77.2 |
| Spin rate on approach shots (rpm) | | | 6351 | 5392 | 6408 | 6329 | 6354 | 6408 | 6301 | 5872 |
| Scuff resistance | | 23° C. | 5 | 5 | 5 | 5 | 5 | 5 | 5 | 4 |
| | | 13° C. | 5 | 5 | 5 | 5 | 5 | 5 | 5 | 3 |
| | | 0° C. | 4 | 4 | 4 | 4 | 4 | 4 | 4 | 3 |
| Ball color | Measurement area diameter, 5 mm | L | 62.0 | 57.0 | 50.2 | 48.6 | 54.2 | 74.4 | 89.6 | 77.9 |
| | | a | 39.2 | 66.5 | −9.6 | −9.5 | 3.2 | −19.7 | −1.1 | −17.5 |
| | | b | 8.4 | 0.1 | −39.2 | −39.7 | 15.6 | 39.6 | −9.8 | 35.8 |
| | | YI | 76.1 | 65.3 | −153.1 | −159.8 | 56.1 | 76.4 | −20.1 | 76.4 |
| | Measurement area diameter, 15 mm | L | 66.6 | 61.9 | 51.4 | 51.5 | 56.2 | 82.6 | 87.4 | 83.5 |
| | | a | 52.2 | 81.5 | −10.3 | −10.3 | 10.9 | −19.5 | −1.8 | −20.6 |
| | | b | 13.2 | 4.6 | −45.5 | −45.6 | 19.3 | 47.1 | −10.2 | 50.6 |
| | | YI | 100.4 | 95.0 | −172.3 | −172.4 | 74.7 | 82.4 | −19.5 | 91.1 |
| | ΔE (between 5-mm value and 15-mm value) | | 14.6 | 16.4 | 6.5 | 6.6 | 8.8 | 11.1 | 2.3 | 16.2 |
| Color change test | ΔE | | 5.6 | 5.1 | 4.8 | 4.4 | 3.8 | 15.0 | 4.0 | 13.0 |
| Appearance | Visibility | | Exc | Exc | Good | Good | Fair | Good | Fair | Good |
| | Elegance | | Exc | Exc | Good | Good | Fair | Fair | NG | Fair |
| | Brightness | | Exc | Exc | Good | Good | Pair | Good | NG | Good |

In the golf ball of Comparative Example 1, a gray-colored core was encased by a clear intermediate layer, which was in turn encased by a colored outer layer. As a result, the gray color of the underlying layer detracted from the visibility, elegance and brightness of the ball.

In the golf ball of Comparative Example 2, the use of a heterocyclic fluorescent dye as the colorant in the outer layer (cover) diminished the discoloration resistance (weather resistance). In addition to a poor discoloration resistance, because the outermost paint layer was applied by clear coating, the resulting ball was somewhat lacking in elegance.

In the golf ball of Comparative Example 3, because the outermost layer was colored an opaque white with titanium oxide, when measured in accordance with JIS Z-8722, there was no colorimetric difference between the value obtained at a measurement area diameter of 5 mm and the value obtained at a measurement area diameter of 15 mm. In addition, because the layer of paint was applied by clear coating, the ball lacked brightness and elegance, and also had a poor visibility.

In the golf ball of Comparative Example 4, because the outermost cover layer was made of an ionomeric material, compared with the urethane material used in the examples of the invention, the ball had a poor spin rate on approach shots and the scuff resistance was also poor. Hence, this golf ball lacked properties acceptable to a skilled golfer. Also, the outermost paint layer was applied by clear coating, as a result of which the ball lacked elegance.

Although some preferred embodiments have been described, many modifications and variations may be made thereto in light of the above teachings. It is therefore to be understood that the invention may be practiced otherwise than as specifically described without departing from the scope of the appended claims.

The invention claimed is:

1. A colored golf ball comprising:

a core, a cover of at least one layer encasing the core, and a layer of paint applied to a surface of an outermost layer of the cover, wherein the outermost cover layer or the paint layer, or both, is colored with a fluorescent dye and titanium oxide and the golf ball itself has a color tone, at a measurement area diameter of 5 mm in a method of measuring the color of a reflecting object according to JIS Z-8722, which, expressed in the Lab color system, satisfies the conditions $35 \leq L$, $-40 \leq a \leq 70$, and $-60 \leq b \leq 60$, wherein the golf ball itself has a color tone at a measurement area diameter of 5 mm and a color tone at a measurement area diameter of 15 mm, such that the color difference $\Delta E$ therebetween is larger than 5.

2. The colored golf ball of claim 1, wherein the fluorescent dye in the outermost cover layer or the paint layer or both is a perinone fluorescent dye, and the color tone of the golf ball itself, expressed in the Lab color system, satisfies the conditions $0 \leq L$, $-10 \leq a \leq 30$, and $10 \leq b \leq 50$.

3. The colored golf ball of claim 1, wherein the fluorescent dye in the outermost cover layer or the paint layer or both is an anthraquinone fluorescent dye, and the color tone of the golf ball itself, expressed in the Lab color system, satisfies the conditions $40 \leq L$, $30 \leq a \leq 70$, and $-20 \leq b \leq 20$.

4. The colored golf ball of claim 1, wherein the fluorescent dye in the outermost cover layer or the paint layer or both is a fluorescent dye selected from the group consisting of perylene, monoazo and quinoline dyes, and the color tone of the golf ball itself, expressed in the Lab color system, satisfies the conditions $60 \leq L$, $-40 \leq a \leq 0$, and $20 \leq b \leq 60$.

5. The colored golf ball of claim 1, wherein the fluorescent dye in the outermost cover layer or the paint layer or both is an anthraquinone fluorescent dye, and the color tone of the golf ball itself, expressed in the Lab color system, satisfies the conditions $35 \leq L$, $-30 \leq a \leq 10$, and $-60 \leq b \leq -20$.

6. The colored golf ball of claim 1, wherein the outermost cover layer is made of a resin selected from the group consisting of thermoset polyurethanes, thermoplastic polyurethanes and reaction injection-molded polyurethanes.

7. The colored golf ball of claim 1, wherein the outermost cover layer is made of a thermoplastic polyurethane.

8. The colored golf ball of claim 7, wherein the thermoplastic polyurethane making up the outermost cover layer includes as a component thereof an aromatic or alicyclic polyisocyanate.

9. The colored golf ball of claim 8, wherein the thermoplastic polyurethane making up the outermost cover layer includes as a component thereof an aromatic polyisocyanate.

10. The colored golf ball of claim 1, wherein the outermost cover layer is colored with a fluorescent dye and titanium oxide and is comprised of 100 parts by weight of a base resin, from 0.01 to 0.10 part by weight of at least one type of fluorescent dye and from 0.1 to 0.5 part by weight of titanium oxide.

11. The colored golf ball of claim 1, wherein a cover having more than one layer comprises one or more intermediate cover layers positioned between the core and the outermost cover layer, wherein the core or an intermediate spherical body comprising the core and the one or more intermediate cover layers is colored white and is optionally encased by a clear resin layer having a thickness of from 0.5 to 2.5 mm; the core or the intermediate spherical body has a color tone, at a measurement area diameter of 5 mm, which, expressed in the Lab color system, satisfies the conditions $40 \leq L$, $-5 \leq a \leq 5$, and $-5 \leq b \leq 5$; and the core or intermediate spherical body which is colored white, or a sphere comprising the white-colored core or intermediate spherical body encased by a clear resin layer, is encased by an outermost cover layer having a thickness of from 0.3 to 2.0 mm.

12. The colored golf ball of claim 1 which has a change in color $\Delta E$ after 24 hours of irradiation with a mercury vapor lamp of 8 or less.

13. The colored golf ball of claim 1, wherein the layer of paint applied to the outermost cover layer is comprised of 100 parts by weight of a base resin composition and from 0.1 to 10 parts by weight of a polarizing pigment.

14. The colored golf ball of claim 1, wherein the layer of paint applied to the outermost cover layer is comprised of 100 parts by weight of a base resin composition and from 0.2 to 8 parts by weight of a polarizing pigment.

* * * * *